US006824841B2

(12) United States Patent
De Voeght et al.

(10) Patent No.: US 6,824,841 B2
(45) Date of Patent: Nov. 30, 2004

(54) INK JET RECORDING MATERIAL AND ITS USE

(75) Inventors: Frank De Voeght, Heist o/d Berg (BE); Peter Slabbinck, Knokke-Heist (BE); Huub Van Aert, Pulderbos (BE)

(73) Assignee: AGFA-Gevaert, Mortsel (BE)

( * ) Notice: Subject to any disclaimer, the term of this patent is extended or adjusted under 35 U.S.C. 154(b) by 378 days.

(21) Appl. No.: 10/090,555

(22) Filed: Mar. 4, 2002

(65) Prior Publication Data

US 2002/0192436 A1 Dec. 19, 2002

Related U.S. Application Data

(60) Provisional application No. 60/291,980, filed on May 18, 2001.

(30) Foreign Application Priority Data

Mar. 26, 2001 (EP) ..... 01000070

(51) Int. Cl.[7] ..... B41M 5/00

(52) U.S. Cl. ..... 428/32.22; 428/32.24; 428/32.26; 428/32.27; 428/32.28

(58) Field of Search ..... 428/32.22, 32.24, 428/32.26, 32.27, 32.28

(56) References Cited

U.S. PATENT DOCUMENTS 5,075,153 A * 12/1991 Malhotra ..... 428/207
5,190,805 A * 3/1993 Atherton et al. ..... 428/195
5,302,436 A * 4/1994 Miller ..... 428/195
5,472,757 A * 12/1995 Ogawa et al. ..... 428/40
5,712,027 A * 1/1998 Ali et al. ..... 428/212
5,723,211 A * 3/1998 Romano et al. ..... 428/328
5,888,629 A 3/1999 Lubar ..... 428/212
6,089,704 A * 7/2000 Burns et al. ..... 347/105
6,190,781 B1 * 2/2001 Tsubaki et al. ..... 428/513
6,197,409 B1 * 3/2001 Bodager et al. ..... 428/212
6,258,451 B1 * 7/2001 Valentini et al. ..... 428/212
6,372,329 B1 * 4/2002 Graczyk et al. ..... 428/195
6,465,081 B2 * 10/2002 Sarkar et al. ..... 428/195
6,592,953 B1 * 7/2003 Ceruti et al. ..... 428/32.24
6,616,991 B1 * 9/2003 Uto ..... 428/32.24
2001/0004487 A1 * 6/2001 Kaneko et al. ..... 428/195
2001/0024771 A1 * 9/2001 Quintens et al. ..... 428/195

FOREIGN PATENT DOCUMENTS

EP 0 407 881 A1 1/1991
EP 0 469 595 A2 2/1992

OTHER PUBLICATIONS

European Search Report, EP 01 000070, Aug. 21, 2001.

* cited by examiner

*Primary Examiner*—Cynthia H. Kelly
*Assistant Examiner*—B. Shewareged
(74) *Attorney, Agent, or Firm*—Joseph T. Guy; Nexsen Pruet, LLC

(57) ABSTRACT

An improved ink jet recording material is disclosed. It comprises on the front side of a subbed polyester at least two ink-receiving layers based on polyvinyl alcohol with a top layer containing a cationic mordant, and on the back side a double layer one of which contains an electronically conductive polymer.

24 Claims, No Drawings

INK JET RECORDING MATERIAL AND ITS USE

This application claims the benefit of Provisional application Ser. No. 60/291,980 filed May 18, 2001.

FIELD OF THE INVENTION

The present invention relates to a particular type of ink jet recording material and its use in printing applications.

BACKGROUND OF THE INVENTION

In the majority of applications printing proceeds by pressure contact of an ink-loaden printing form with an ink-receiving material which is usually plain paper. The most frequently used impact printing technique is known as lithographic printing based on the selective acceptance of oleophilic ink on a suitable receptor.

In recent times however so-called non-impact printing systems have replaced classical pressure-contact printing to some extent for specific applications. A survey is given e.g. in the book "Principles of Non Impact Printing" by Jerome L. Johnson (1986), Palatino Press, Irvine, Calif. 92715, USA.

Among non-impact printing techniques ink jet printing has become a popular technique because of its simplicity, convenience and low cost. Especially in those instances where a limited edition of the printed matter is needed ink jet printing has become a technology of choice. A recent survey on progress and trends in ink jet printing technology is given by Hue P. Le in *Journal of Imaging Science and Technology* Vol. 42 (1), Jan/Febr 1998.

In ink jet printing tiny drops of ink fluid are projected directly onto an ink receptor surface without physical contact between the printing device and the receptor. The printing device stores the printing data electronically and controls a mechanism for ejecting the drops image-wise. Printing is accomplished by moving the print head across the paper or vice versa. Early patents on ink jet printers include U.S. Pat. Nos. 3,739,393, 3,805,273 and 3,891,121.

The jetting of the ink droplets can be performed in several different ways. In a first type of process a continuous droplet stream is created by applying a pressure wave pattern. This process is known as continuous ink jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink jet printing several jets are deflected to a different degree and thus record the image (multideflection system)

According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method"), or by means of discrete thermal pushes (so-called "bubble jet" method, or "thermal jet" method).

Ink compositions for ink jet typically include following ingredients dyes or pigments, water and/or organic solvents, humectants such as glycols, detergents, thickeners, polymeric binders, preservatives, etc. It will be readily understood that the optimal composition of such an ink is dependent on the ink jetting method used and on the nature of the substrate to be printed. The ink compositions can be roughly divided in:

- water based; the drying mechanism involves absorption, penetration and evaporation;
- oil based; the drying involves absorption and penetration;
- solvent based; the drying mechanism involves primarely evaporation;
- hot melt or phase change: the ink vehicle is liquid at the ejection temperature but solid at room temperature; drying is replaced by solidification;
- UV-curable; drying is replaced by polymerization.

It is known that the ink-receiving layers in ink-jet recording elements must meet different stringent requirements:

- The ink-receiving layer should have a high ink absorbing capacity, so that the dots will not flow out and will not be expanded more than is necessary to obtain a high optical density.
- The ink-receiving layer should have a high ink absorbing speed (short ink drying time) so that the ink droplets will not feather if smeared immediately after applying.
- The ink dots that are applied to the ink-receiving layer should be substantially round in shape and smooth at their peripheries. The dot diameter must be constant and accurately controlled.
- The receiving layer must be readily wetted so that there is no "puddling", i.e. coalescence of adjacent ink dots, and an earlier absorbed ink drop should not show any "bleeding", i.e. overlap with neighbouring or later placed dots, or non-printed areas.
- Transparent ink-jet recording elements must have a low haze-value and be excellent in transmittance properties.
- After being printed the image must have a good resistance regarding waterfastness, lightfastness, and good endurance under severe conditions of temperature and humidity.
- The ink jet recording element may not show any curl or sticky behaviour if stacked before or after being printed.
- The ink jet recording element must be able to move smoothly through different types of printers.

All these properties are often in a relation of trade-off. It is difficult to satisfy them all at the same time.

It is known that the presence in the ink accepting layer of absorptive pigments such as silica, kaolin, talc, aluminum oxide, boehmite, etc. improve the absorption capacity, the obtainable colour density and the drying time. Many patent applications have described this effect for many different binder-systems. U.S. Pat. No. 3,357,846 describes pigments such as kaolin, talc, bariet, $TiO_2$ used in starch and PVA. U.S. Pat. No. 3,889,270 describes silica in gelatin, PVA and cellulose. Pigments and particles have also been described in patent applications including DE 2,925,769, GB 2,050,866, U.S. Pat. Nos. 4,474,850, 4,547,405, 4,578,285, WO 88 06532, U.S. Pat. No. 4,849,286, EP 339604, EP 400681, EP 407881, EP 411638 and U.S. Pat. No. 5,045,864 (non-exhaustive list).

These particulates are dispersed in various types of binders of which the most common types such as gelatin, polyvinyl alcohol, polyvinyl pyrrolidone, and various types of cellulose derivatives. These conventional binders are mentioned in numerous patent documents.

It is further known to use various types of film-forming polymers to improve the waterfastness of the coated ink receiving layer by increasing its adhesion to the support.

It is also known to improve the waterfastness of the finished printed image by the incorporation of cationic pigments or mordanting polymers bearing cationic quaternary groups such as ammonium-, sulphonium and phosphonium groups. These polymers interact with most typical ink jet inks resulting in a better anchoring of the dye in the binder. Typical examples of such descriptions are U.S. Pat. Nos. 4,371,582, 4,575,465, 4,649,064, GB 2 210 071 and EP 423829.

Many of the described or commercialy available ink jet recording materials suffer from one or more of the following deficiencies

- sticking of front side to back side of the freshly manufactured ink jet recording element when rolled up as a web or, or when stacked after being cut in formats;
- attraction of dust of the ink jet printed material when it is used as a master for the exposure of a printing plate such as an offset plate or a silk screen, or of a contact duplicating film; this is due to triboelectric differences;
- insufficient sharpness of the printed dots;
- insufficient resistance to feathering;
- transport problems during printing;
- a lack of sufficient density of full areas of the printed image;
- migration of ink from the printed side to the back side during occasional rolling up of the film during printing;
- lack of dimensional stability. This property is of extreme importance when the printed images emanate from digitally stored information corresponding to more then one colour selection, and the printed images are to be used as masters.

OBJECTS OF THE INVENTION

It is an object of the present invention to provide an ink jet recording material, and methods for its use, which is improved for sticking, the attraction of dust, and transport problems.

It is a further object of the invention to provide an ink jet recording element, and methods for its use, on which sharp dots can be printed.

It is a further object of the invention to provide an ink jet recording element, and methods for its use, which is improved for dimensional stability.

SUMMARY OF THE INVENTION

The above mentioned objects are realised by two different embodiments.

According to a first embodiment, the objects of the present invention are realized by providing an ink jet recording material comprising a transparent polyester support, and on the front side of said support a layer pack (A) of at least two ink-receiving layers comprising a polyvinyl alcohol binder whereby the top layer of said pack further comprises a cationic mordant and a spacing agent, and on the back side of said support a double layer pack (B) comprising, in order, a latex subbing layer containing an electronically conductive polymer, and a second backing layer containing a crosslinked hydrophilic binder and a spacing agent.

According to a second embodiment, the objects of the present invention are realized by providing an ink jet recording material comprising a transparent polyester support, and on the front side of said support a layer pack (A) of at least two ink-receiving layers comprising a polyvinyl alcohol binder whereby the top layer of said pack further comprises a cationic mordant and a spacing agent, and on the back side of said support a double layer pack (B') comprising, in order, a latex subbing layer and a second backing layer containing an electronically conductive polymer and a spacing agent.

So the essential difference between the two embodiments is the position of the incorporation of the electronically conductive polymer.

A most suitable electronically conductive polymer is a poly(3,4-ethylenedioxythiophene)/polystyrene sulphonate complex.

Methods describing the use of the disclosed materials as masters for the exposure of a lithographic printing plate precursor or a silk screen are explicitly considered as belonging to the scope of the present invention.

DETAILED DESCRIPTION OF THE INVENTION

The layer assemblage and the ingredients of the ink jet recording material of the present invention will now be explained in detail.

The Ink-Receiving Layers

The ink-receiving layer assemblage is a multilayer pack containing at least two layers, and more preferably three layers. An essential ingredient of those layers is a polyvinyl alcohol (PVA) binder. This PVA can be an unmodified, partially or almost completely hydrolized PVA, Commercially available unmodified PVA binders include e.g. MOWIOL, trade mark of Hoechst AG, POLYVIOL WX 48/20, trade mark of Wacker Co., or AIRVOL 230, trade mark of Air Products Co. On the other hand it can be a modified PVA, e.g. a cationic PVA such as GOHSEFIMER K-210, trade mark of Nippon Goshei Co., or a silanol modified PVA, such as POVAL R2105, POVAL R1130, and POVAL R3109 of Kuraray CO.

The PVA can be used as the sole binder or can be admixed with small amounts of other well-known hydrophilic binders such as cellulosic derivatives, gelatin, polyvinyl pyrrolidone, etc.

At least the top layer of the multilayer ink-receiving layer pack further contains a cationic mordant and a spacing agent.

An example of a useful cationic mordant is a cationic polyurethane, such as WITCOBOND 213, trade mark of Crompton Corp.

Other suitable cationic compounds are poly (diallyldialkylammonium chloride) compounds, e.g. a poly (diallyldimethylammonium chloride) or, in short, a poly (dadmac). These compounds are commercially available from several companies, e.g. Aldrich, Calgon, Clariant, BASF, EKA Chemicals, Nalco Italiana and Nippon Goshei.

Other useful cationic compounds include dadmac copolymers such as copolymers with acrylamide; dimethylamine-epichlorohydrine copolymers, e.g. POLYFIX 700, trade name of Showa High Polymer Co.; other Polyfix grades which could be used are POLYFIX 601, POLYFIX 301, POLYFIX 301A, POLYFIX 250WS, and POLYFIX 3000; NEOFIX E-117, trade name of Nicca Chemical Co., a polyoxyalkylene polyamine dicyanodiamine; REDIFLOC 4150, trade name of EKA Chemicals, a polyamine; MADAME (methacrylatedimethylaminoethyl= dimethylaminoethyl methacrylate) or MADQUAT (methacryloxyethyltrimethylammonium chloride) modified polymers, e.g. ROHAGIT KL280, ROHAGIT 210, ROHAGIT SL144, PLEX 4739L, PLEX 3073 from Röhm, DIAFLOC KP155 and other DIAFLOC products from Diafloc Co., and BMB 1305 and other BMB products from EKA chemicals; cationic epichlorohydrin adducts such as POLYCUP 171 and POLYCUP 172, trade names from Hercules Co.; from Cytec industries: CYPRO products, e.g. CYPRO 514/515/516, SUPERFLOC 507/521/567; cationic cellulose derivatives such as CELQUAT L-200, H-100, SC-240C, SC-230M, trade names of Starch & Chemical Co., and QUATRISOFT LM200, UCARE polymers JR125, JR400, LR400, JR30M, LR30M and UCARE polymer LK; fixing agents from Chukyo Europe: PALSET JK-512, PALSET JK512L, PALSET JK-182, PALSET JK-220, WSC-173, WSC-173L, PALSET JK-320, PALSET JK-320L and PALSET JK-350; polyethyleneimine and copolymers, e.g. LUPASOL, trade name of BASF AG; triethanolamine-titanium-chelate, e.g. TYZOR, trade name of Du Pont Co.; copolymers of vinylpyrrolidone such as VIVIPRINT 111, trade name of ISP, a methacrylamido propyl dimethylamine copolymer; with dimethylaminoethylmethacrylate such as COPOLYMER 845 and COPOLYMER 937, trade names of ISP; with vinylimidazole, e.g. LUVIQUAT CARE, LUVITEC 73W, LUVITEC VPI55 K18P, LUVITEC VP155 K72W, LUVIQUAT FC905, LUVIQUAT FC550, LUVIQUAT HM522, and SOKALAN HP56, all trade names of BASF AG; polyamidoamines, e.g. RETAMINOL and NADAVIN, trade marks of Bayer AG; and phosphonium compounds such as disclosed in EP 609930. Still other cationic compounds include cationic aluminum oxide, cationic boehmite, and poly(aluminumhydroxychloride) such as SYLOJET A200, trade name of Grace Co. Still further cationic polymers include polyvinylamines, e.g. PVAM-0595B from Esprit Co., and cationic modified acrylics, e.g. ACRIT RKW319SX, trade name of Tasei Chemical Industries, and RD134 from Goo Chemical.

The nature and concentration of the spacing agent present in the top layer of the ink receiving pack must be chosen so that the best compromise between full area density and transparency of the non-printed areas is obtained. So advantageously the spacing agents are transparent beads. Classes of useful spacing agents include following:

- the spherical polymeric beads disclosed in U.S. Pat. No. 4,861,818;
- the alkali-soluble beads of U.S. Pat. No. 4,906,560 and EP 584407
- the insoluble polymeric beads disclosed in EP 466982.
- polymethylmethacrylate beads;
- copolymers of methacrylic acid with methyl- or ethylmethacrylate;
- TOSPEARL siloxane particles, trade name of Toshiba Co.
- SEAHOSTAR polysiloxane-silica particles (e.g. type KE-P50), trade name of Nippon Shokubai Co.
- CHEMIPEARL, spherical polymeric particles, marketed by Misui Petrochemical Industries, Ltd.

A preferred spacing agent is polymethylmethacrylate or derivatives. A most useful derivative is a copoly (methylmethacrylate-stearylmethacrylate 98%/2%), stabilized by poly(styrene-maleic acid, sodium salt). This compound is preferable incorporated in a coated layer as a gelatinous dispersion.

Apart from the ingredients essential to the invention the ink-receiving layers may contain still other types of substances.

Preferably they contain one or more surfactants, which can be chosen from the numerous known classes of surfactants. Most suitable are cationic surfactants, including e.g. N-alkyl dimethyl ammonium chloride, palmityl trimethyl ammonium chloride, dodecyldimethylamine, tetradecyldimethylamine, ethoxylated alkyl guanidine-amine complex, oleamine hydroxypropyl bistrimonium chloride, oleyl imidazoline, stearyl imidazoline, cocamine acetate, palmitamine, dihydroxyethylcocamine, cocotrimonium chloride, alkyl polyglycolether ammonium sulphate, ethoxylated oleamine, lauryl pyridinium chloride, N-oleyl-1,3-diaminopropane, stearamidopropyl dimethylamine lactate, coconut fatty amide, oleyl hydroxyethyl imidazoline, isostearyl ethylimidonium ethosulphate, lauramidopropyl PEG-dimoniumchloride phosphate, palmityl trimethylammonium chloride, and cetyltrimethylammonium bromide.

The ink-receiving layers may contain some minor amounts of pigments to such extent that they do not affect disadvantageously the transparency of the global ink jet recording element.

The pigment may be chosen from organic material such as polystyrene, polymethylmethacrylate, silicones, urea-formaldehyde condensation polymers, polyesters and polyamides. In general however, it is an inorganic porous pigment, such as silica, talc, clay, koalin, diatomaceous earth, calcium carbonate, magnesium carbonate, aluminium hydroxide, aluminium oxide, titanium oxide, zinc oxide, barium sulfate, calcium sulfate, zinc sulfide, satin white, boehmite and pseudo-boehmite.

The layers may also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalicanhydride, urea phosphate, triphenylphosphate, glycerolmonostearate, propylene glycol monostearate, tetramethylene sulfone, n-methyl-2-pyrrolidone, n-vinyl-2-pyrrolidone.

The Support, The Subbing Layers, The Backing Layers

The support of the ink jet recording material used in accordance with the present invention is a transparent polyester support, e.g. a polyethylene terephthalate or polyethylene naphtalate. Polyethylene terephthalate (PET) is the preferred support. This support is subbed on both sides with a so-called latex subbing layer. An essential ingredient of this latex subbing layer is an adhesion promoting latex. A preferred class of latex polymers for this purpose are vinylidene chloride-containing copolymers having carboxyl functional groups. Illustrative of such polymers are (1) copolymers of vinylidene chloride and an unsaturated carboxylic acid such as acrylic or methacrylic acid, (2) copolymers of vinylidene chloride and a half ester of an unsaturated carboxylic acid such as the monomethylester of itaconic acid, (3) terpolymers of vinylidene chloride, itaconic acid and an alkyl acrylate or methacrylate such as ethyl acrylate or methyl methacrylate, and (4) terpolymers of vinylidene chloride, acrylonitrile or methacrylonitrile and an unsaturated carboxylic acid such as acrylic acid or methacrylic acid.

In a most preferred embodiment the latex polymer is co(vinylidene chloride-methyl acrylate-itaconic acid; 88%/10%/2%). This copolymer is prepared by emulsion polymerization using 0.5% MERSOLAT H (trade-mark of Bayer AG) as emulsifying agent. It is necessary to add extra surfactant, a so-called post-stabilizer, to the latex in order to assure a good stability on storage. An excellent storage stability is obtained when 4% of ULTRAVON W, trade mark of Ciba-Geigy, or DOWFAX, trade mark of Dow, is used.

As a further preferred ingredient of the coating solution of the latex subbing layer colloidal silica may be added. A preferred compound is KIESELSOL 100F (trade-mark of Bayer AG), average particle size 25–30 nm. The ratio of the amount of latex to silica is preferably about 80/20.

The latex subbing layer may further contain surfactants and biocides.

It is an essential feature of the first embodiment of the present invention that the latex subbing layer of the back side of the support further contains an electronically conductive polymer. Substances having electronic conductivity instead of ionic conductivity have a conductivity independent from moisture. They are particularly suited for use in the production of antistatic layers with permanent and reproducible conductivity.

Many of the known electronically conductive polymers are highly coloured which makes them less suited for use in films used for colour separation, but some of them of the group of the polyarenemethylidenes, e.g. polythiophenes and polyisothianaphthene are not prohibitively coloured and transparent, at least when coated in thin layers. As a result polythiophene derivatives are a preferred type of conductive compounds for use in the present invention.

The production of conductive polythiophenes is described in preparation literature mentioned in the above mentioned book "Science and Applications of Conducting Polymers", p. 92.

For ecological reasons the coating of antistatic layers should proceed where possible from aqueous solutions by using as few as possible organic solvents. The production of antistatic coatings from aqueous coating compositions being dispersions of polythiophenes in the presence of polyanions is described in EP 0 440 957. Thanks to the presence of the polyanion the polythiophene compound is kept in dispersion.

Preferably said polythiophene has thiophene nuclei substituted with at least one alkoxy group, or —$O(CH_2CH_2O)_n$ $CH_3$ group, n being 1 to 4, or, most preferably, thiophene nuclei that are ring closed over two oxygen atoms with an alkylene group including such group in substituted form.

Preferred polythiophenes for use according to the present invention are made up of structural units corresponding to the following general formula:

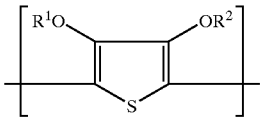

in which:

each of $R^1$ and $R^2$ independently represents hydrogen or a $C_{1-4}$ alkyl group or together represent an optionally substituted $C_{1-4}$ alkylene group or a cycloalkylene group, preferably an ethylene group, an optionally alkyl-substituted methylene group, an optionally $C_{1-12}$ alkyl- or phenyl-substituted 1,2-ethylene group, a 1,3-propylene group or a 1,2-cyclohexylene group.

The most preferred compound is poly(3,4-ethylenedioxythiophene), (PEDT) with following formula:

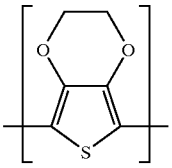

The preparation of said polythiophene and of aqueous polythio-phene-polymeric polyanion dispersions containing said polythiophene is described in EP 0 440 957, cited above.

Suitable polymeric polyanion compounds required for keeping said polythiophenes in dispersion are provided by acidic polymers in free acid or neutralized form. The acidic polymers are preferably polymeric sulphonic acids. Examples of such polymeric acids are polymers containing vinyl sulfonic acid and styrene sulfonic acid or mixtures thereof.

The anionic acidic polymers used in conjunction with the dispersed polythiophene polymer have preferably a content of anionic groups of more than 2% by weight with respect to said polymer compounds to ensure sufficient stability of the dispersion. Suitable acidic polymers or corresponding salts are described e.g. in DE-A-25 41 230, DE-A-25 41 274, DE-A-28 35 856, EP-A-14 921, EP-A-69 671, EP-A-130 115, U.S. Pat. Nos. 4,147,550, 4,388,403 and 5,006,451.

The weight ratio of polythiophene polymer to polymeric polyanion compound(s) can vary widely, for example from about 50/50 to 15/85.

The most preferred polymeric polyanion for use in combination with the polythiophene derivative, e.g. PEDT, is polystyrene sulphonate (PSS).

Although a polythiophene/polyanion complex is the preferred electronically conductive substance others can be used, e.g. polypyroles, polyanilines, sulphonated poly-p.-phenylenes, sulphonated polyfluorenes, polyphenylenevinylenes which can be carboxylated or sulphonated, polythienylenevinylenes which can be sulphonated or carboxylated. Optionally these polymers can also be used as complex with a polymeric polyanion, e.g. polystyrene sulphonate.

In the first embodiment of the present invention the layer pack (B) on the back side comprises, apart from the latex subbing layer with the conductive compound, a second backing layer comprising a crosslinked hydrophilic binder and a spacing agent.

In a preferred embodiment the hydrophilic binder of the second backing layer is gelatin. Appropriate crosslinkers (or hardeners) include those of the epoxide type, those of the ethylenimine type, those of the vinylsulfone type, e.g.1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The gelatin can also be hardened with fast-reacting hardeners such as carbamoylpyridinium salts as disclosed in U.S. Pat. No. 4,063,952. In a preferred embodiment the hardener is a vinylsulfone.

The second backing layer further contains a spacing agent. This spacing agent may be chosen from the same types as described for the top layer of the ink receiving layers. A most suitable compound is again copoly (methylmethacrylate-stearylmethacrylate 98%/2%), stabilized by poly(styrene-maleic acid, sodium salt). This compound is preferable incorporated in the second backing layer as a gelatinous dispersion.

In a second embodiment of the present invention the layer pack (B') on the back side of the polyester support comprises a latex subbing layer closest to the support, and an electroconductive layer as second backing layer. In this embodiment the latex subbing layer preferably contains no or substantially no electronically conductive compound. Furtheron the composition is similar to the one described for the latex subbing layer of the first embodiment. In the second embodiment the electronically conductive compound is present in the second backing layer. This electronically conductive compound is preferably chosen from the same compounds as decribed above for the first embodiment. A most suitable compound is again the poly(3,4-ethylenedioxythiophene/polystyrene sulphonate complex. The layer further contains a spacing agent which again is preferably chosen from the classes described above. A most suitable compound is again copoly(methylmethacrylate-stearylmethacrylate 98%/2%), stabilized by poly(styrene-maleic acid, sodium salt). The binder of this backing layer may be hydrophilic or hydrophobic and may be crosslinked or not. A preferred binder is a film-forming polymethylmethacrylate. Furtheron this layer may contain other additives such as biocides and surfactants.

The latex subbing layer on the front side of the polyester support has preferably essentially the same composition as the latex subbing layer of the back side, preferably however without the presence of an electronically conductive polymer.

Furtheron on the front side there is also a so-called gelatin subbing layer between the latex subbing layer and the ink-receiving layers. In a preferred embodiment this gelatin subbing layer contains a mixture of gelatin and colloidal silica. A preferred compound is again KIESELSOL 300F (trade-mark of Bayer AG). A plasticizing compound can be used in order to avoid the formation of cracks in the dried layer due to the occurence of excessive shrinking of the layer during drying. Plasticizing agents are well-known in the art. Low-molecular weight compounds (e.g. acetamide, glycerin) as well as polymeric latices (e.g. polyethylacrylate, poly-n.-butylacrylate) can be used for this purpose. Furtheron the gelatin subbing layer may contain one or more surfactants. Useful surfactants include: ULTRAVON™ W, an aryl sulfonate from CIBA-GEIGY, DOWFAX from Dow CO., and ARKOPAL™ N060 (previously HOSTAPAL™ W); a nonylphenylpolyethylene-glycol from HOECHST.

The thickness of the gelatin subbing layer is preferably comprised between 0.1 and 1 $\mu$m.

Coating Technology

In a particularly preferred embodiment the two latex subbing layers, the gelatin subbing layer, and the second backing layer are coated "on line" in a continuous process in the manufacturing alley of the polyester itself. Molten polyester is extruded and longitudinally stretched. Then the first latex subbing layer is applied on the upper side and the second latex subbing layer, optionally conductive, is applied on the back side. Then the subbed polyester is stretched in the transversal direction. The gelatin subbing layer is applied on the upper side, and finally the second backing layer is applied on the back side.

The ink-receiving layers are coated "off-line". Any well-known coating technique can be used such as dip coating, air-knife coating, slide hopper coating, and curtain coating.

Use of Ink Jet Image as Master in Printing Processes.

An ink jet image produced image-wise from digitally stored information can be used as master for the exposure of a lithographic printing plate. The method involves the following steps, in order,:

(1) preparing an ink jet recording material according to the present invention as explained above, (2) jetting information-wise droplets of an UV-absorbing ink onto the front surface of said ink jet recording material by means of an ink jet printer thus forming a printed image, (3) exposing overall by actinic light a lithographic printing plate precursor through a mask consisting of the printed image formed by steps (1) and (2), (4) developing the exposed lithographic printing plate precursor into a lithographic printing plate.

The ink used for the formation of the image may be any type of ink. Preferred however are aqueous inks. The UV absorbing colorant of the ink is preferably carbon black, but in principle also a mixture of dyes adding up to black can be used provided that the UV density is sufficient.

Multicolour printing can be performed by exposing several printing plates through different ink jet mask produced from digital information corresponding to different colour separations. This application illustrates the importance of the dimensional stability of the ink jet material of the present invention.

Similarly, the ink jet image can be used as mask for the exposure of a silk screen. The method involves the following steps, in order,:

(1) preparing an ink jet recording material according to the present invention as explained above, (2) jetting information-wise droplets of an ink absorbing ink onto the front surface of said ink jet recording material by means of an ink jet printer thus forming a printed image, (3) exposing overall by actinic light a silk screen through a mask consisting of the printed image formed by steps (1) and (2), (4) developing the exposed silk screen into a silk screen printing element.

Similarly, multicolour printing or printing with different spot colours, e.g. on textile fabrics, is possible.

The invention will now be illustrated by the following examples without however being limited thereto.

EXAMPLES

Example 1

1.1 Composition of Invention and of Comparison Materials

Composition of Invention 1 Material According to the First Eembodiment:

On the front side of a PET support there wer e coated three ink-receiving layers having polyvinyl alcohol (MOWIOL) as binder. The top layer further comprises a polyurethane having cationic groups (WITCOBOND) and as spacing agent copoly(methylmethacrylate-stearylmethacrylate 98%/2%), stabilized by poly(styrene-maleic acid, sodium salt). Between the ink-receiving layer pack and the PET there were coated on line a latex subbing layer containing essentially as adhesive latex co(vinylidene chloride-methyl acrylate-itaconic acid; 88%/10%/2%), colloidal silica and surfactants, and a gelatin subbing layer containing essentially gelatin and colloidal silica.

The first backing layer is an electroconductive latex subbing layer comprising as adhesive latex co(vinylidene chloride-methyl acrylate-itaconic acid; 88%/10%/2%), and poly(3,4-ethylenedioxythiophene)/polystyrene sulphonate complex as conductive polymer. Further it contains colloidal silica (KIESELSOL 100F), a surfactant and a biocide. The second backing layer comprises gelatin crosslinked by a divinylsulfon hardener, and as matting agent a gelatinous dispersion of copoly(methylmethacrylate-stearylmethacrylate 98%/2%), stabilized by poly(styrene-maleic acid, sodium salt).

Composition of Invention 2 Material According to the Second Embodiment:

The front side composition is the same as for the invention 1 material. The first backing layer is a latex subbing layer similar to the one of example 1.1 but without electronically conductive compound. The second backing layer comprises poly(3,4-ethylenedioxythiophene)/polystyrene sulphonate complex as conductive polymer, copoly (methylmethacrylate-stearylmethacrylate 98%/2%), stabilized by poly(styrene-maleic acid, sodium salt) as spacing agent, colloidal silica, a polyethylene emulsion, and film-forming polymethylmethacrylate as binder.

Comparison Materials:

comparison 1: AJM CLEAR FILM, a commercially available material, marketed by Agfa-Gevaert, a material based on a gelatin/polyvinyl pyrrolidone binder mixture on both sides.

comparison 2: Epson Transparant (S041063), a commercial transparent material (microporous, based on boehmite)

1.2 Evaluation of Physical Properties 1.2.1 Average Dot Size on an Epson 3000 Printer invention 1 material: 62 $\mu$m, comparison 2 material: 74.5 $\mu$m.

1.2.1 Tests on Sticking

The printed front sides of the invention and comparison materials were after 10 minutes of drying pressed against different back layer packs and kept so for 24 hours.

The tested back layer packs were the back layer packs of the invention 1 material, of the invention 2 material and of the comparison 1 material.

The printed front side of comparison material 1 sticked to all tested backsides and there was ink tranfer from front to back. The printed front side of invention material 1 only sticked to the back side of comparison material 1 but not to the backsides of invention materials 1 and 2, and there was no ink transfer.

1.2.3 Printed Full Area Density

On an Epson 9000 printer (medium quality, normal dot)

Invention 1 material: visual density 3.44; UV density 2.81

Comparison 1 material: visual density 2.54; UV density 2.18

1.2.4 Wipe Tests

Freshly printed full areas were wiped in function of time with a little stick having a tip of cotton-wool. Invention material 1 was resistant to wiping after 1 á 2 minutes, while this was the case after 5 minutes for comparison material 1.

1.2.5 Dimensional Stability Tests

In following table 1 the dimensional stability values are expressed as $\mu$m/m (reversible RV coefficients). The measurements were performed on samples cut both in the length and in the width direction.

TABLE 1

| Sample | Dim. St. length | Dim. St. width | Mean value |
|---|---|---|---|
| Inv. 1 | 13.5 | 13.2 | 13.4 |
| Inv. 2 | 12.8 | 12.6 | 12.7 |
| Comp. 1 | 23.4 | 22.8 | 23.1 |

Example 2

Comparison of Different Cationic Mordants

Samples were coated with similar composition as invention sample 1 from the previous example with the exception that the nature of the cationic mordant was varied.

Following compounds were tested cationic polyurethane dispersions: WITCOBOND 213 (cf. previous example), ENOREX PU750, ENOREX PU950 (trade names of Collano Co.), CHROMOELASTIC C-4480 (trade name of Chromogenia-Units SA, Italy);

poly(dadmac) varianten: CAT FLOC 71259, CAT FLOC CFL, CATFLOC CL (trade names of Nalco Italiana S.r.l., Italy);

copolymers of dimethylamine and epichlorohydrine: REDIFLOC 4150 (trade name of EKA Chemicals) and POLYFIX 601 (trade name of Showa High Polymer Co.).

General Test Results all samples showed a comparable good density and dot size;

the polyurethanes were better for drying characteristics;

the image quality was also the best for the polyurethanes.

What is claimed is:

1. An ink jet recording material comprising a transparent polyester support, and on the front side of said support a layer pack (A) comprising a latex subbing layer, a gelatin subbing layer, and at least two ink-receiving layers comprising a polyvinyl alcohol binder whereby the top layer of said ink-receiving layers further comprises a cationic mordant and a spacing agent, and on the back side of said support a double layer pack (B) comprising, in order, a latex subbing layer containing an electronically conductive polymer, and a second backing layer containing a crosslinked hydrophilic binder and a spacing agent.

2. An ink jet recording material according to claim 1 wherein said cationic mordant is a cationic polyurethane latex.

3. An ink jet recording material according to claim 1 wherein said cationic mordant is a poly (diallyldialkylammonium chloride).

4. An ink jet recording material according to claim 1 wherein said spacing agent in said top ink-recording layer on the front side, and/or in said second backing layer is copoly (methylmethacrylate-stearylmethacrylate 98%/2%), stabilized by poly(styrene-maleic acid, sodium salt).

5. An ink jet recording material according to claim 1 wherein said layer pack (A) on the front side comprises three layers.

6. An ink jet recording material according to claim 1 wherein said electronically conductive polymer in said latex subbing layer on the back side is a polythiophene/polyanion complex.

7. An ink jet recording material according to claim 6 wherein said polythiophene is poly(3,4-ethylenedioxythiophene).

8. An ink jet recording material according to claim 6 wherein said polyanion is polystyrene sulphonate.

9. An ink jet recording material according to claim 1 wherein said hydrophilic binder of said second backing layer is gelatin.

10. An ink jet recording material according to claim 9 wherein said gelatin is crosslinked by means of a vinylsulfone hardener.

11. An ink jet recording material comprising a transparent polyester support, and on the front side of said support a layer pack (A) comprising a latex subbing layer, a gelatin subbing layer, and at least two ink-receiving layers comprising a polyvinyl alcohol binder whereby the top layer of said ink-receiving layers further comprises a cationic mordant and a spacing agent, and on the back side of said support a double layer pack (B') comprising, in order, a latex subbing layer and a second backing layer containing an electronically conductive polymer and a spacing agent.

12. An ink jet recording material according to claim 11 wherein said cationic mordant is a cationic polyurethane latex.

13. An ink jet recording material according to claim 11 wherein said cationic mordant is a poly (diallyldialkylammonium chloride).

14. An ink jet recording material according to claim 11 wherein said spacing agent in said top ink-recording layer on the front side, and/or in said second backing layer is copoly (methylmethacrylate-stearylmethacrylate 98%/2%), stabilized by poly(styrene-maleic acid, sodium salt).

15. An ink jet recording material according to claim 11 wherein said layer pack (A) on the front side comprises three layers.

16. An ink jet recording material according to claim 11 wherein said electronically conductive polymer in said second backing layer is a polythiophene/polyanion complex.

17. An ink jet recording material according to claim 16 wherein said polythiophene is poly(3,4-ethylenedioxythiophene).

18. An ink jet recording material according to claim 16 wherein said polyanion is polystyrene sulphonate.

19. A method for the preparation of a lithographic printing plate involving the following steps, in order,:

(1) preparing an ink jet recording material as defined by claim 1, (2) jetting information-wise droplets of a UV-absorbing ink onto the front surface of said ink jet recording material by means of an ink jet printer thus forming a printed image, (3) exposing overall by actinic light a lithographic printing plate precursor through a mask consisting of the printed image formed by steps (1) and (2), (4) developing the exposed lithographic printing plate precursor into a lithographic printing plate.

20. A method according to claim 19 wherein said ink is an aqueous ink containing carbon black.

21. A method according to claim 19 wherein said ink is an aqueous ink containing a mixture of dyes adding up to black.

22. A method for the preparation of a silk screen printing element involving the following steps, in order,:

(1) preparing an ink jet recording material as defined by claim 1, (2) jetting information-wise droplets of an ink onto the front surface of said ink jet recording material by means of an ink jet printer thus forming a printed image, (3) exposing overall by actinic light a silk screen through a mask consisting of the printed image formed by steps (1) and (2), (4) developing the exposed silk screen into a silk screen printing element.

23. A method according to claim 22 wherein said ink is an aqueous ink containing carbon black.

24. A method according to claim 22 wherein said ink is an aqueous ink containing a mixture of dyes adding up to black.

* * * * *